United States Patent [19]

Fang

[11] Patent Number: 4,729,586

[45] Date of Patent: Mar. 8, 1988

[54] CYLINDER DOOR LOCK WITH A DEAD BOLT ADJUSTABLE IN TWO SIZES

[75] Inventor: Yau C. Fang, Chiayi, Taiwan

[73] Assignee: Posse Lock Manufacturing Co. Ltd., Chiayi, Taiwan

[21] Appl. No.: 865,135

[22] Filed: May 20, 1986

[51] Int. Cl.[4] ..... E05C 1/16

[52] U.S. Cl. ..... 292/337; 292/DIG. 53; 292/DIG. 60

[58] Field of Search ..... 292/1, 337, DIG. 60, 292/DIG. 53

[56] References Cited

U.S. PATENT DOCUMENTS 4,372,594 2/1983 Gater ..... 292/DIG. 60 X 4,602,490 7/1986 Glass et al. ..... 292/337 X

*Primary Examiner*—Richard E. Moore

*Attorney, Agent, or Firm*—Holman & Stern

[57] ABSTRACT

This cylinder door lock has a base which contains a guarding plate having two notches—one is to link with a spring plate and a fixing cross pin and the other with a stopping plate. Covering outside of the base is an extending shell which has its bottom wall linked with an actuating plate having its two actuating hooks exposed outside the bottom wall so as to link with the actuating device of the knob. And by means of the extending of the extending shell, the distance between the actuating hooks and the dead bolt is able to be altered.

1 Claim, 12 Drawing Figures

CYLINDER DOOR LOCK WITH A DEAD BOLT ADJUSTABLE IN TWO SIZES

BACKGROUND OF THE INVENTION

Door locks used nowadays, in order to meet different size requirements, are manufactured in two different sizes to accomodate the width of the frame post in a door. Therefore, lock manufacturers have to prepare different molds for making different sizes of locks, and retailers are obliged to devote more shelf space for storing them. Moreover, since the two different sizes of locks are very similar to each other, generally 60 mm and 70 mm, the consumers would always be confused unless they have specific knowledge about the size of locks.

SUMMARY OF THE INVENTION

In order to solve the problems in the art mentioned above, the present invention has been worked out to provide a cylinder door lock with a dead bolt adjustable in two different sizes, comprising a base which contains a dead bolt, a bolting plate, a safety bolt, an unlocking plate, an extending unlocking plate and a guarding plate. The guarding plate has two notches; one of them can hook up with a spring plate and a fixing cross pin and the other with a stopping plate. The base couples with an extending shell which has its bottom wall linked with an actuating plate that has two actuating hooks exposed outside so as to link with the actuating device of the knob. And by means of the extending of the extending shell, the distance between the actuating hook and the dead bolt is able to be altered into two kinds.

DETAILED DESCRIPTION OF THE INVENTION

Figure 1:
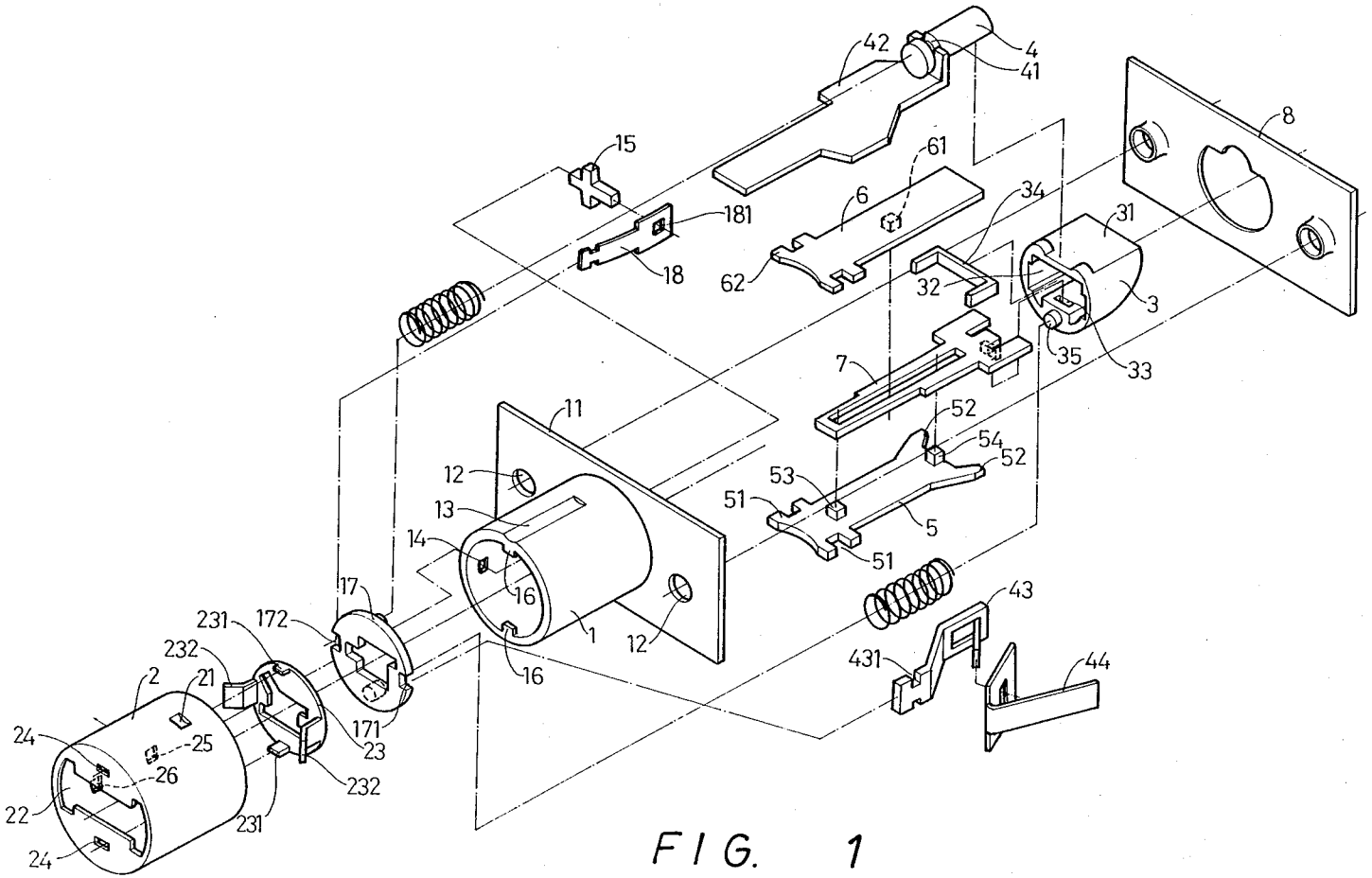
FIG. 1 is an assembly view of the parts of the cylinder door lock of the present invention.

FIG. 1, the assembly view of the present invention, shows a base 1, an extending shell 2, a dead bolt 3, a safety bolt 4, an unlocking plate 5 and an extending unlocking plate 6.

The base 1 includes a fixing plate 11 cut with two apertures 12 for fixing the base 1 on the side face of a door. A straight slot 13 on the base 1 is used to receive an inward projection 21 in it so that the extending shell 2 is able to slide linearly along it. Also, a fixing aperture 14 on the side of the base 1 is provided for a fixing cross pin 15 to fix in. The left end of the base 1 has two locking projections 16 for confining a guarding plate 17 in and preventing it from falling off, and the right side of the base 1 is fixing plate 11.

The extending shell 2 is shaped as a cylinger with a bottom wall, which is cut to from an aperture 22 therein for the unlocking plate 5, the extending unlocking plate 6 and a bolting plate 7 to extend out. Inside the extending shell 2 the projection 21 is formed to match with the slot 13 of the base 1 so that the extending shell 2 is to slide along it. An actuating plate 25 is to be assembled from the interior of the extending shell 2 with its bottom wall by disposing a pair of projections 231 on it with a pair of apertures 24 in the end wall of the extending shell 2, and a pair of actuating arms 232 on the actuating plate 23 is then to extend out of the aperture 22 for linking with the actuating device of the knob (not shown in the figures for they are the same as those used conventionally) so as to keep the base 1 stable and be able to pull both the unlocking plate 5 and the extending unlocking plate 6. In addition, a pair of fixing apertures 25, 26 in the side of the extending shell 2 are able to face against the fixing aperture 14 respectively.

The dead bolt 3, as FIGS. 1, 10, 11 and 12 show, is formed with a flat surface 31 on its top for a safety bolt 4 to ride on. It has an aperture 32 to receive a bolting plate 7 and a locking aperture 33 for a projection on the bottom of the bolting plate 7 to dispose in and an U-shaped plate 34 is filled into it to fix the bolting plate 7; a round projection 35 is for one end of a spring to rest on. These structures are just the same as conventional ones.

The safety bolt 4 can move to and fro on the flat surface 31 of the dead bolt 3. It has a ring slot to combine with an actuating plate 42 which projects like a trapezoid able to contact with a stopping plate 43 that is always supported pressed by a spring plate 44 in such a way that the plate 43 is forced to stop the plate 42 inwardly: a pair of slots 431 in the plate 43 dispose into a notch 171 of a guarding plate 17 to keep the plate 43 in position.

The unlocking plate 5 is cut with ear hooks 51 at one end for the actuating device of the knob to connect with; the other end of the unlocking plate has a pair of tips 52 which can push outward the stopping plate 43 attaining the purpose of unlocking the lock. The unlocking plate 5 has as well a pair of projections 53, 54 which are to guide the bolting plate 7 to slide on the unlocking plate 5 in a straight line, Besides, the projections 53, 54 not only lead the bolting plate 7 to act but contact with a projection 61 on the bottom surface of an extending unlocking plate 6 so that the contact of the projections 61, 53 will actuate the unlocking plate 5 to unlock when a pair of ear hooks 62 of the extending unlocking plate 6 are hooked and actuated by the actuating device of the knob.

The extending unlocking plate 6 is so designed that it can alter the distance between the dead bolt 3 and the bottom wall of the extending shell 2; the main point in this invention is to alter the distance between the actuating hooks 232 and the dead bolt 3. Actually, the extending unlocking plate 6, in order to match with the extending of the extending shell, is set to make the unlocking plate 5 able to be actuated to make the tips 52 of the unlocking plate 5 push outwards the stopping plate 43, forming an action of actuating the dead bolt 3 when the actuating device of the knob is operated, because the unlocking plate 5 has limited length. Moreover, one side of the bolting plate 7 is extended to push on the fixing cross pin 15, preventing the pin 15 from dropping off.

The guarding plate 17 has a notch 172 for disposing a spring plate 18 which is cut with a fixing aperture 181 for matching with the pin 15. The pin 15 is usually pressed by the spring plate 18, extending out through the fixing aperture 14 of the base 1 and disposing in the fixing aperture 25 or 26. That is, through the inward pressing to dispose the cross pin 15 into the aperture 25 or 26 from outside of the extending shell 2, the position of the extending shell 2 can be altered and fixed stable at one of the two positions selected.

After having assembled the dead bolt 3, the safety bolt 4, the unlocking plate 6 and the bolting plate 7, etc. together in the base 1, a cover 8 sets the base 1 and the fixing plate 11 on the side of the door frame, making a complete lock.

Figure 2:
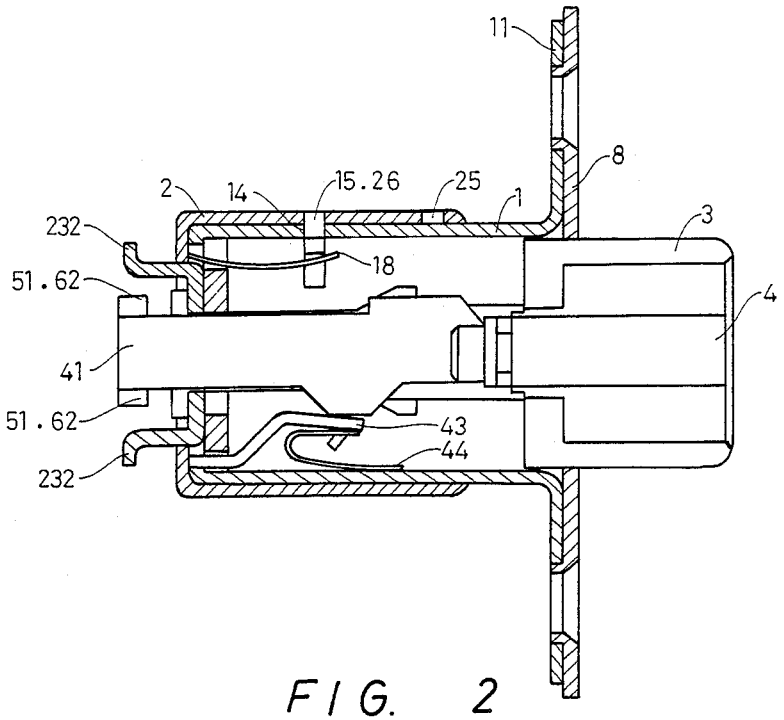
FIG. 2 is a side cross-sectional view of the cylinder door lock adjusted in the short size in this invention.

The assembled present invention adjusted in the short size i.e. without being extended as shown in FIG. 2 is is explained as follows.

When the fixing cross pin 15 disposes in the fixing aperture 14 of the base 1 and that of the extending shell 2, the extending shell 2 becomes immovable and the distance between the bottom wall of the extending shell 2 and the dead bolt 3 is short—generally said to be 60 mm—the actuating hook 232 and the ear hooks 51 of the unlocking plate 5 and the ear hooks 62 of the extending unlocking plate 6 all expose outside of the extending shell 2, and all the ear hooks 51, 62 link with the actuating device of the knob; the actuating hook 232 presses on the outward side of the actuating device keeping the extending shell 2 and the base 1 immovable but the unlocking plate 5 and the extending unlocking plate 6 able to be pulled when the knob is turned. Before pulling up the extending plate 5, the spring plate 44 pushes the stopping plate 43 inwards until it is stopped at the trapezoid projection of the actuating plate 42, which constitutes a condition that the dead bolt 3 can be pulled inward by pulling movement of the unlocking plate 5. That is, the bolting plate 7 and the safety bolt 4 are not in the state of anti-burglar action.

Figure 3:
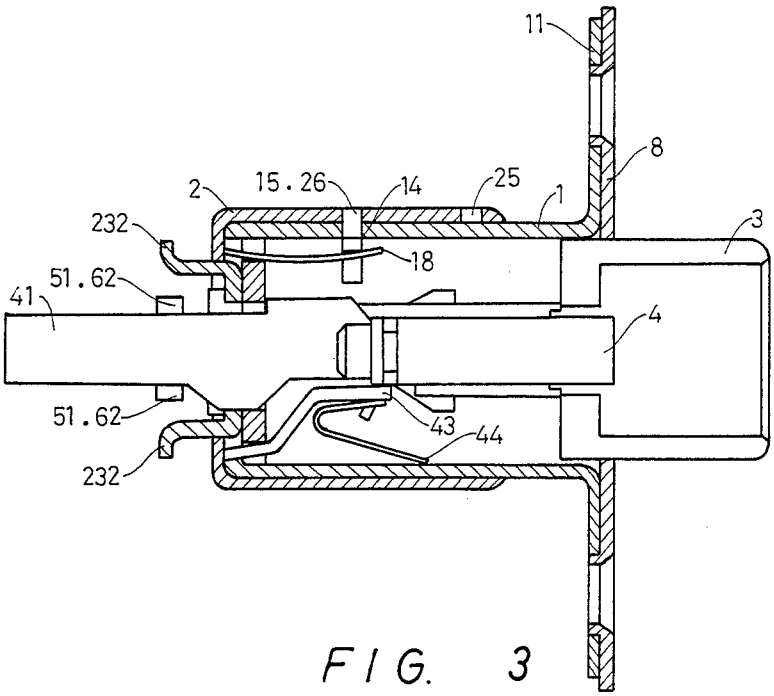
FIG. 3 is a side cross-sectional view of the safety bolt moved inward in the cylinder door lock adjusted in the short size and locked in this invention.

When the assembled lock is fixed in door and locked, the safety bolt, being halted by the door frame, will retract inward as shown in FIG. 3 and the trapezoid part of the actuating plate 42 is no longer to stop the stopping plate 43 pushed inward by the spring plate 44. Therefore, the stopping plate 43 is able to contact with the middle part of the bolting plate 7. That is, when someone illegally tries to get the dead bolt 3 moved inward, since the bolting plate 7 is formed with a stair step at its side, the bolting plate 7 can not move back stopped by the stopping plate 43, so the dead bolt 3 can neither be illegally pressed which means an anti-burglar action.

Figure 4:
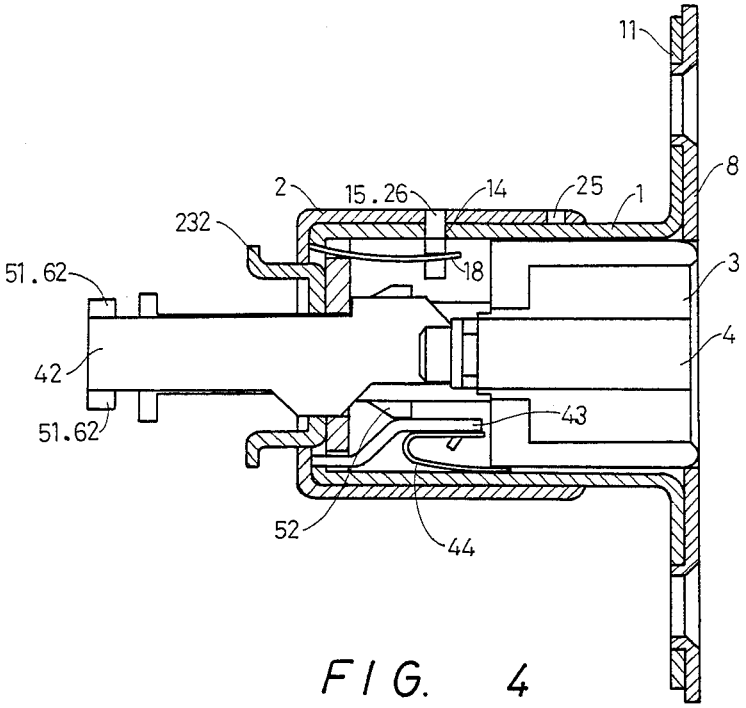
FIG. 4 is a side cross-sectional view of the unlocking plate in operation after the cylinder door lock adjusted in the short size and locked in this invention.
Figure 5:
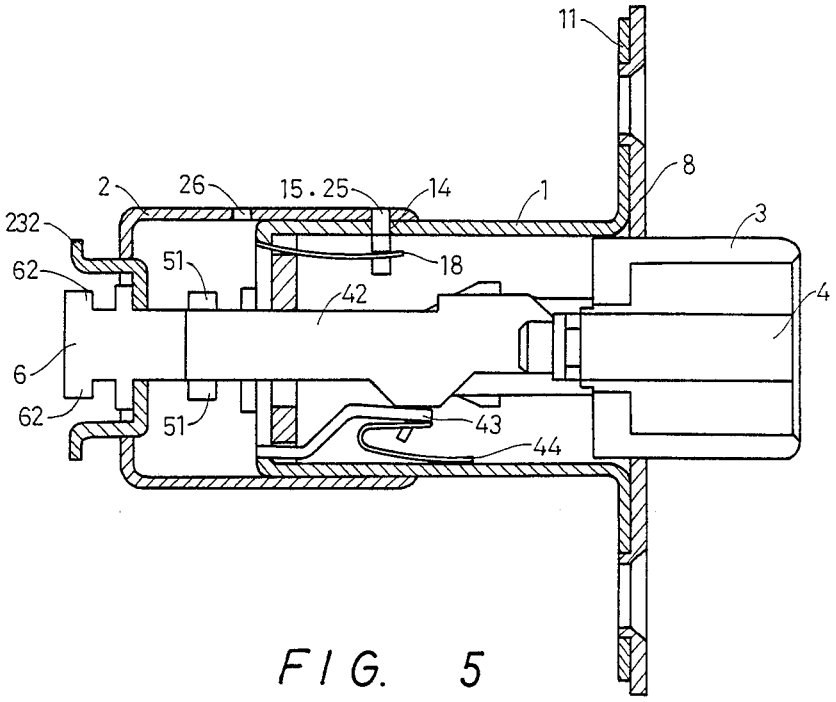
FIG. 5 is a side cross-sectional view of the cylinder door lock adjusted in the long size in this invention.

When a door is closed and the lock maintains the locked condition as shown in FIG. 3, if the actuating device of the knob is turned, the unlocking plate 5 is to be actuated and its tips 52 are naturally to press the stopping plate 43 which will no longer lean on the middle of the bolting plate 7 so that the bolting plate 7 will move along its slot pulling the dead bolt 3 inward as shown in FIG. 4, due to the actuation of the locking projection 53 of the unlocking plate 5.

If the fixing cross pin 15 is pryed to move away from the aperture 26 of the extending shell 2 by a sharp object, the extending shell 2 can be moved to the long position to enable the fixing cross pin 15 to enter the aperture 25 of the extending shell—so-called 70 mm. Under this condition, the unlocking plate 5 is kept at the wider opening of the actuating plate 23 and the ear hooks 62 of the extending unlocking plate 6 at the narrower opening of the actuating plate 23. Therefore, when the extending shell 2 is moved to the long position, the extending unlocking plate 6 will be stopped at the outside of the extending shell 2, exposing itself outside of the extending shell 2 and keep its projection 61 contacting with the projection 53 of the unlocking plate 5. Consequently, via the transfer of the unlocking plate 6 to actuate the dead bolt 3, the unlocking plate 5 can function to unlock this lock in the same way as shown in FIG. 2.

Figure 6:
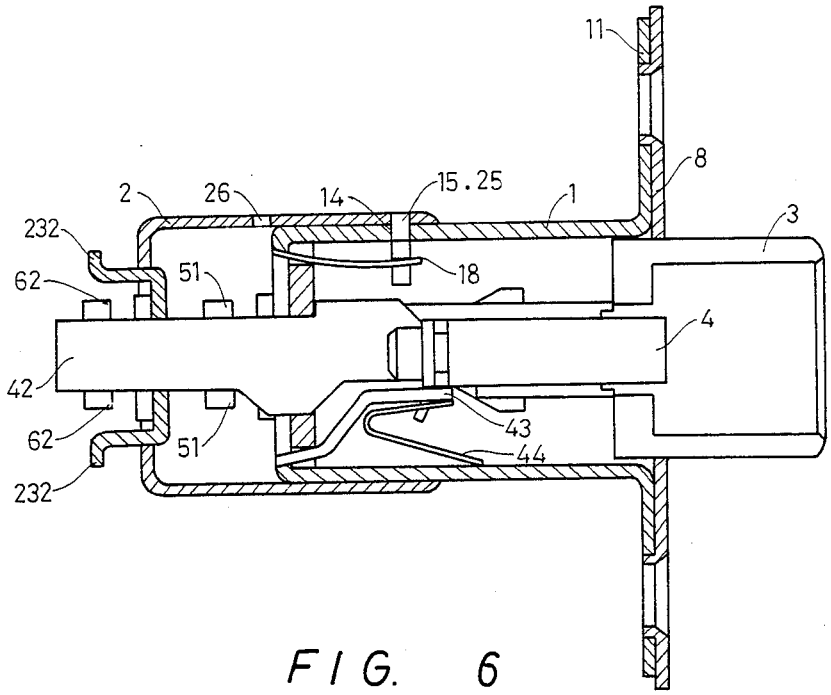
FIG. 6 is a side cross-sectional view of the safety bolt moved inward in the cylinder door lock adjusted in the long size and locked in this invention.
Figure 7:
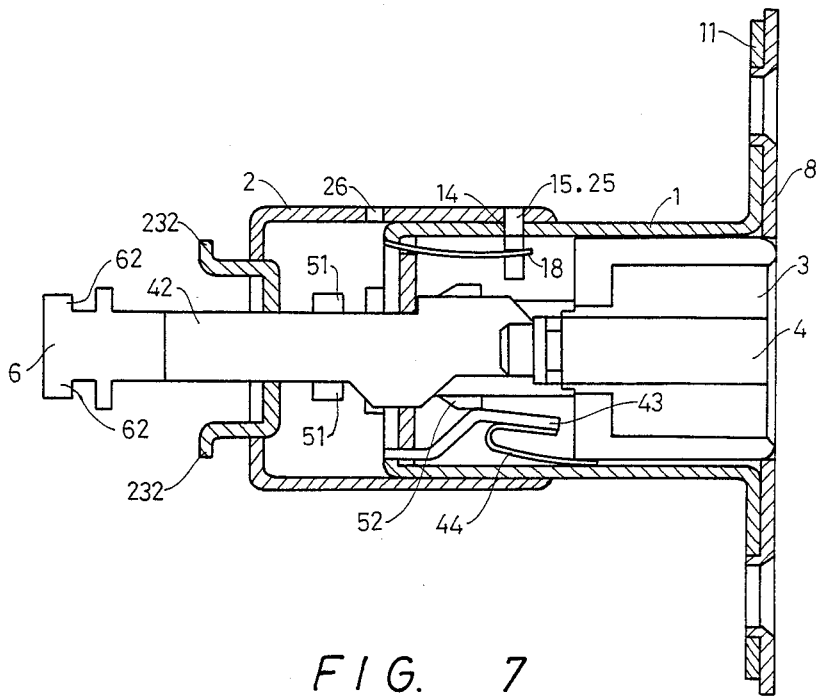
FIG. 7 is a side cross-sectional view of the extending unlocking plate in operation after the cylinder door lock adjusted in the long size and locked in this invention.

The anti-burglar and unlocking structures of this lock with the long position are shown in FIGS. 6, 7 and their moving actions are the same as shown in FIGS. 3, 4.

Figure 8:
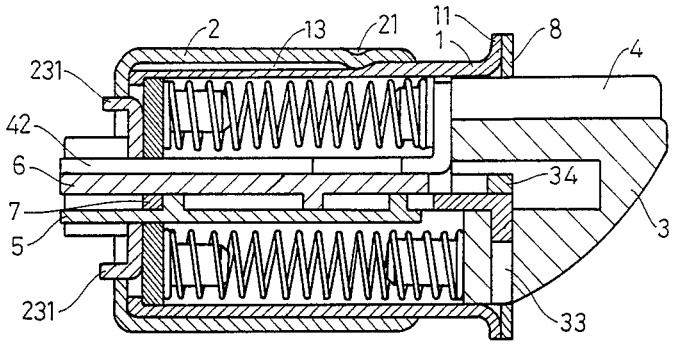
FIG. 8 is a side cross-sectional view of the cylinder door lock adjusted in the short size in this invention.
Figure 9:
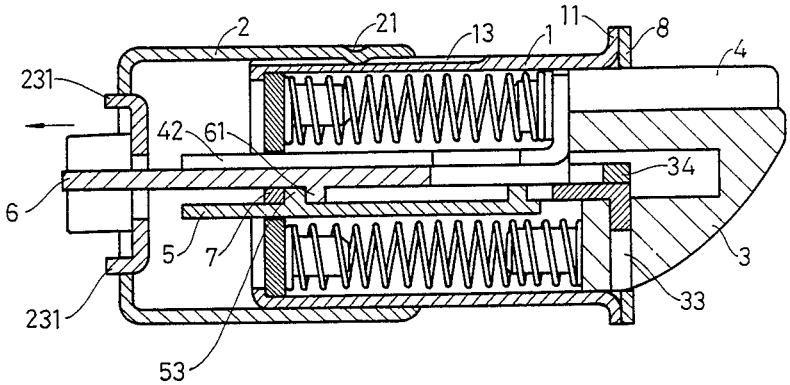
FIG. 9 is a side cross-sectional view of the cylinder door lock adjusted in the long size in this invention.
Figure 10:
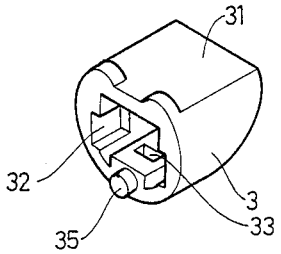
FIG. 10 is a perspective view of the dead bolt in this invention.
Figure 11:
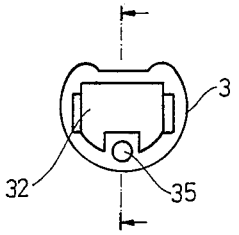
FIG. 11 is an elevational view of the dead bolt in this invention.
Figure 12:
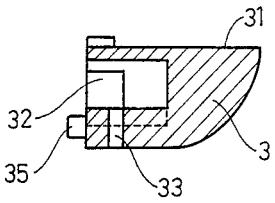
FIG. 12 is a cross-sectional view of A—A in FIG. 11.

FIGS. 8, 9 are the cross-sectioned views of this lock with the long and short positions viewed from another B angle. For easy understanding, FIG. 8 with the actuating plate 42 not sectioned can show us that the extending unlocking plate 6 abutes under the actuating plate 42 and under the extending unlocking plate 6 is the bolting plate 7 under which lies the unlocking plate 5. In addition, as shown in FIG. 9, the projection 61 contacts with the projection 53 of the unlocking plate 5 when the extending unlocking plate 6 is pulled to extend out so the plate 6 can move the unlocking plate 5 and the bolting plate 7 at the same time; meanwhile the plate 7 makes use of the U-shaped plate 34 and dispose itself in the aperture 33 of the dead bolt 3 to enable the dead bolt 3 to be actuated to move at the same time.

Conclusively, the present invention is based on the extention of the extending shell 2 to alter the distance between its bottom wall and the dead bolt 3 and on the movement of the unlocking plate 5 alone or of the extending unlocking plate 6 together operated by the actuating device, and this movement can move the dead bolt 3, making the cylinder door lock possible to alter the distance for suiting to the door frame size.

What is claimed is:

1. A cylinder door lock adjustable for two sizes comprising:

a base which includes a cylinder and a fixing plate; said cylinder having a straight slot for an extending shell to slide along, integral projections on its end remote from the fixing plate, and a fixing aperture;

an extending shell received on the cylinder, the shell having a bottom wall, a large aperture in the bottom wall and two fixing apertures spaced along the length of the shell; an actuating plate in the extending shell against the bottom wall, the actuating plate having two actuating hooks exposed outside of the extending shell through the large aperture for attaching the actuating plate to an actuating device of a doorknob and stabiliizing the cylinder;

a dead bolt having a flat surface, a safety bolt associated with the dead bolt and shaped to ride and move on said surface, a locking aperture in the dead bolt;

a bolting plate having a projection fitting in said locking aperture in the dead bolt, and an elongate aperture adjacent the projection;

an extending uplocking plate above the bolting plate, the extending unlocking plate having a pair of ear hooks for connecting with the actuating device of the door knob, and a locking projection on its bottom surface fitting in the elongate aperture of the bolting plate for sliding therein;

an unlocking plate below the bolting plate, the unlocking plate having a pair of ear hooks for connecting with the actuating device, two projections to fit in the elongate aperture of the bolting plate for guiding same in a straight line, and a pair of tips extending out obliquely from the unlocking plate;

the safety bolt having a ring slot, and actuating plate formed with a trapezoidal portion and a connection with said ring slot, a guarding plate fitting in the cylinder of the base adjacent the internal projections, a stopping plate having a connection with the guarding plate, a spring plate internally of the cylinder for pressing the stopping plate inwardly toward the actuating plate;

a fixing bolt in the cylinder extending through the fixing aperture in the cylinder for engagement selectively in one of the fixing apertures in the extending shell, and a further spring plate connected between the guarding plate and the fixing bolt;

the extending shell being movable for selectively receiving the fixing bolt in one of said two fixing apertures forming respectively short and long distances between the actuating plate and the deal bolt; in the short distance, the ear hooks of the extending locking plate and the ear hooks of the unlocking plate being connectable with the actuating device; in the long distance, the extending shell pulling out the extending unlocking plate to make the locking projection of the extending unlocking plate contact with one of the projections of the unlocking plate at one end of the elongate aperture of the bolting plate; when the ear hooks of the unlocking plate are actuated alone or with those of the extending locking plate by the actuating device, the tips of the unlocking plates push the stopping plate outwardly enabling the dead bolt to be moved.

* * * * *